US008437664B2

(12) United States Patent
Nelson

(10) Patent No.: US 8,437,664 B2
(45) Date of Patent: May 7, 2013

(54) DEVELOPMENT APPARATUS AND PRINTER

(75) Inventor: Eric G Nelson, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 316 days.

(21) Appl. No.: 13/015,933

(22) Filed: Jan. 28, 2011

(65) Prior Publication Data

US 2012/0195644 A1 Aug. 2, 2012

(51) Int. Cl.
*G03G 15/10* (2006.01)

(52) U.S. Cl.
USPC ..... 399/237; 399/249

(58) Field of Classification Search ..... 399/232, 399/233, 237, 239, 249
See application file for complete search history.

(56) References Cited

U.S. PATENT DOCUMENTS

| | | | | |
|---|---|---|---|---|
| 4,264,185 | A * | 4/1981 | Ohta | 399/232 |
| 5,839,363 | A | 11/1998 | Yanagisawa et al. | |
| 5,882,828 | A | 3/1999 | Kato et al. | |
| 5,899,606 | A * | 5/1999 | Tano et al. | 399/239 |
| 7,003,248 | B2 * | 2/2006 | Kurotori et al. | 399/249 |
| 7,356,287 | B2 | 4/2008 | Guzman et al. | |
| 7,522,865 | B2 | 4/2009 | Hasdai et al. | |
| 2009/0097883 | A1 | 4/2009 | Guzman et al. | |
| 2009/0148190 | A1 | 6/2009 | Nelson et al. | |
| 2009/0279911 | A1 | 11/2009 | Raz et al. | |
| 2010/0215405 | A1 | 8/2010 | Patton et al. | |

FOREIGN PATENT DOCUMENTS

| | | | |
|---|---|---|---|
| WO | 2009131571 | A1 | 10/2009 |

* cited by examiner

*Primary Examiner* — Hoang Ngo

(57) ABSTRACT

A development apparatus and a printer that includes the development apparatus employ a flow director to regulate fluid flow in the apparatus. The apparatus includes a first roller, a chamber, and a pair of electrodes between the first roller and the chamber. The apparatus further includes a second roller adjacent to the first roller, wherein the flow director is between the second roller and a first electrode of the pair. The flow director includes an overflow flow path to divert some fluid from a recirculation flow path that extends to and from the chamber. The printer includes an imager in contact with an image developer and an image transferer in contact with the imager. The image developer includes a plurality of development apparati.

20 Claims, 3 Drawing Sheets

DEVELOPMENT APPARATUS AND PRINTER

CROSS-REFERENCE TO RELATED APPLICATIONS

N/A

STATEMENT REGARDING FEDERALLY SPONSORED RESEARCH OR DEVELOPMENT

N/A

BACKGROUND

Modern printing techniques can be broadly categorized into two groups: analog and digital. Common analog printing techniques are offset lithography, flexographic, gravure and screen printing. Digital printing includes a number of techniques among which inkjet and electrophotographic printing are the most prevalent. Digital printing has an advantage over its analog counterpart in that printed output can be digitally altered, meaning that every printed page can be different. Moreover, digital printing methods are often cost effective, particularly at low run lengths (number of pages), and can have print quality comparable to analog printing methods, in many instances. In particular, since the mid-1980s, electrophotographic (EP) printing, commonly known as laser printing, has been a popular choice among consumers who demand high quality, professional looking printed communications. State-of-the-art commercial EP printers currently feature image quality that rivals lithographic offset printers and offer printing speeds that are compatible for virtually any print job.

Liquid electrophotographic (LEP) printing is a variant of EP printing that has superior image quality and the advantage of being compatible with a broad range of substrate types (coated and uncoated paper, plastic sheet, cardboard, folded cartons, shrink wrap and labels, for example). The ink used in LEP printing, as known as liquid toner, uses a dielectric carrier fluid and pigmented resin as colorant particles. Electrophoretic attraction of charged ink particles to a laser exposed photoconductor forms the image, which is transferred to an intermediate transfer medium prior to final transfer to the substrate. High quality output can be achieved at print speeds consistent with many commercial printing requirements.

The print quality from LEP printers is dependent on a number of properly functioning parts of the printer. For example, a plurality of development units carries the liquid toner of multiple colors to form the image. Liquid toner flows along a recirculation flow path in the development unit to provide an amount of liquid toner to a development roller that is subsequently transferred to the photoconductor for imaging. Excess liquid toner not provided to the development roller either continues circulating in the recirculation flow path of the development unit or is returned to an external reservoir where it is filtered and reconditioned (e.g., mixed with fresh ink) and then reused. Typical development units are sensitive to fluctuations in the amount and a makeup or replenishment rate of liquid toner at any given time and in any given location in the recirculation flow path. The sensitivity to the fluctuations may lead to formation of dark streaks in the printed image. Further in some instances, the sensitivity to the fluctuations may lead to build up of sludge within the development unit. The sludge build-up may result in more frequent replacement of the development units, which can be costly.

BRIEF DESCRIPTION OF THE DRAWINGS

The various features of examples may be more readily understood with reference to the following detailed description taken in conjunction with the accompanying drawings, where like reference numerals designate like structural elements, and in which.

Figure 1A:
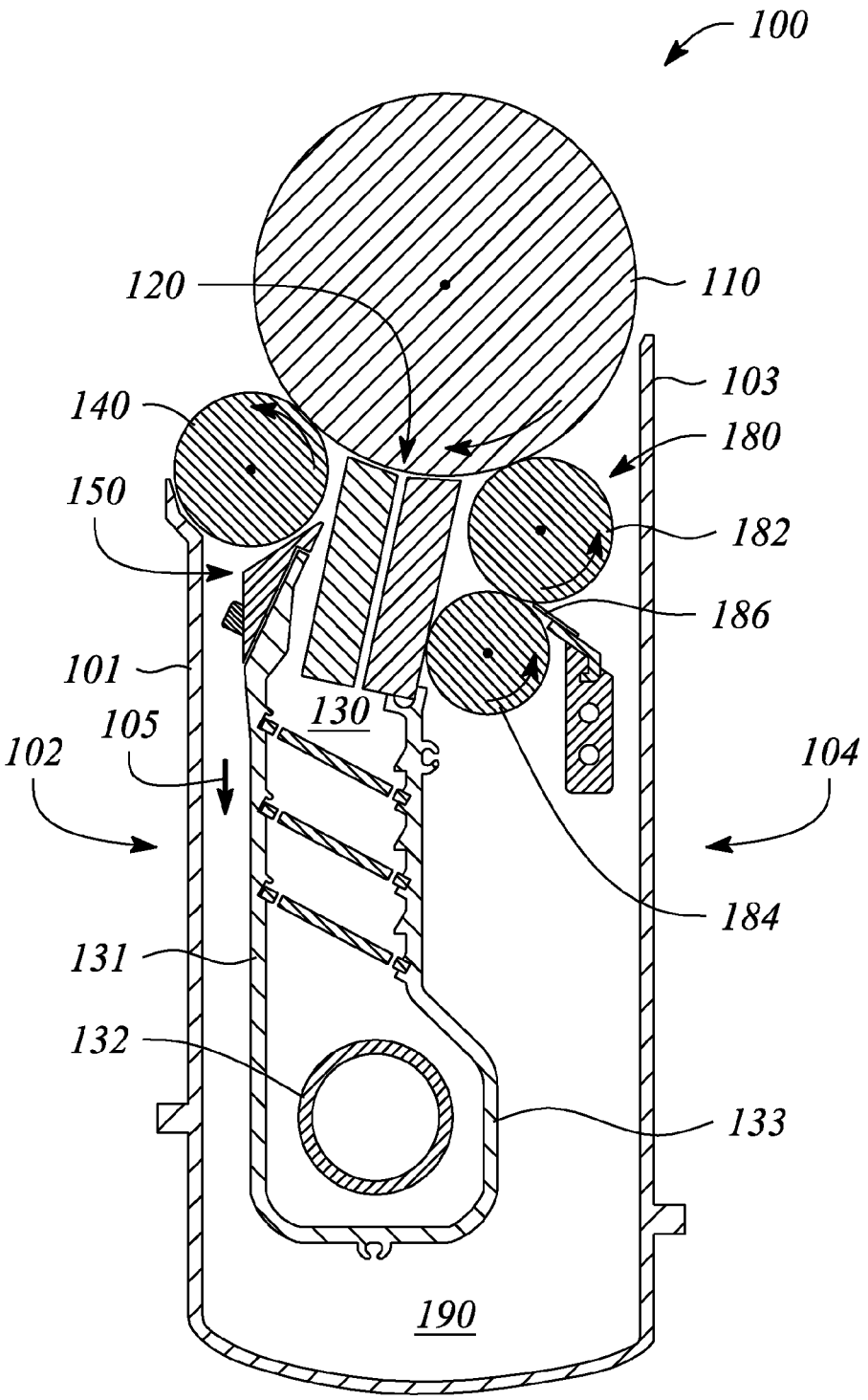
FIG. 1A illustrates a cross sectional view of a development apparatus, according to an example of the principles described herein.

Certain examples have other features that are one of in addition to and in lieu of the features illustrated in the above-referenced figures. These and other features are detailed below with reference to the preceding drawings.

DETAILED DESCRIPTION

Examples in accordance with the principles described herein include a development apparatus that includes a flow director as means for regulating fluid flow in a recirculation flow path to a fluid chamber. In particular, the flow director diverts some fluid from a recirculation flow path into an overflow path that leads to a collection tray that flows to an external reservoir, according to some examples. Diverting some fluid may reduce a pressure in the recirculation flow path leading to improved performance of the developer apparatus, for example. Further, examples in accordance with the principles described herein include a printer that employs a plurality of image developers, where the image developers include the flow director.

Specifically, the flow director may decrease a pressure within the development apparatus while fluid is pumped along the recirculation flow path, according to some examples. The pressure decrease may facilitate integrity of seals within the development apparatus. Moreover, the flow director may reduce, and in some examples, prevent damage to various rollers associated with the recirculation flow path as they rotate in the development apparatus, for example. In some examples, the flow director substantially regulates fluid flow in the recirculation flow path in a manner that dispenses a consistent, metered amount of fluid from the development apparatus. Furthermore, in some examples the flow director also has an affect of reducing sludge build-up in a cleaning flow path.

In contrast, printers, such as an LEP printer, without a flow director in its developer units, according to principles described herein, may not have enough liquid toner released by one or more of its developer units. As such, dark streaks may be seen on a printed substrate, even near the start of a print cycle. For example, cyan ink in a developer unit of the LEP printer without a flow director may show streaking on or about the third printed page. Moreover, if too much liquid toner ink is released via the recirculation flow path by the developer unit of the LEP printer without a flow director, the cleaning system of the developer unit may become starved of fluid, and subsequently may fill with sludge. The sludge may potentially lead to or cause a catastrophic failure of the developer unit, for example. In addition, a fluid-starved cleaning system may also produce print defects on the printed substrate.

In some examples according to the principles described herein, the flow regulation provided by the flow director maintains one or both of a consistent amount of fluid in the recirculation flow path and a consistent amount of fluid in a cleaning flow path. The consistent amount of fluid in the cleaning flow path of the development apparatus described herein may reduce sludge that causes failure of the development apparatus, for example. In various printer examples described herein, the consistent amount of fluid, such as liquid toner, in the recirculation and cleaning flow paths of the plurality of image developers may reduce, and in some examples may minimize, streaking on the printed substrate for the duration of a print cycle, for example.

As used herein, the article 'a' is intended to have its ordinary meaning in the patent arts, namely 'one or more'. For example, 'a developer' means one or more developers and as such, 'the developer' explicitly means 'the developer(s)' herein. The phrase 'at least' as used herein means that the number may be equal to or greater than the number recited. The term 'about' as used herein means either that the number recited may differ by plus or minus 10%, for example, 'about 5' means a range of 4.5 to 5.5 or that the number is within normal measurement tolerances of the measurement equipment used. The term 'between' when used in conjunction with two numbers such as, for example, 'between about 2 and about 50' includes both of the numbers recited. Any ranges of values provided herein include values within or between the provided ranges. The term 'substantially' as used herein means a majority, or almost all, or all, or an amount with a range of about 51% to 100%, for example. Also, any reference herein to 'top', 'bottom', 'upper', 'lower', 'up', 'down', 'back', 'front', 'left' or 'right' is not intended to be a limitation herein. The designations 'first', 'second' and so on are used herein for the purpose of distinguishing between items, such as 'first side' and 'second side', and are not intended to imply any sequence, order or importance to one item over another item or any order of operation, unless otherwise indicated. Moreover, examples herein are intended to be illustrative only and are presented for discussion purposes and not by way of limitation.

Figure 1B:
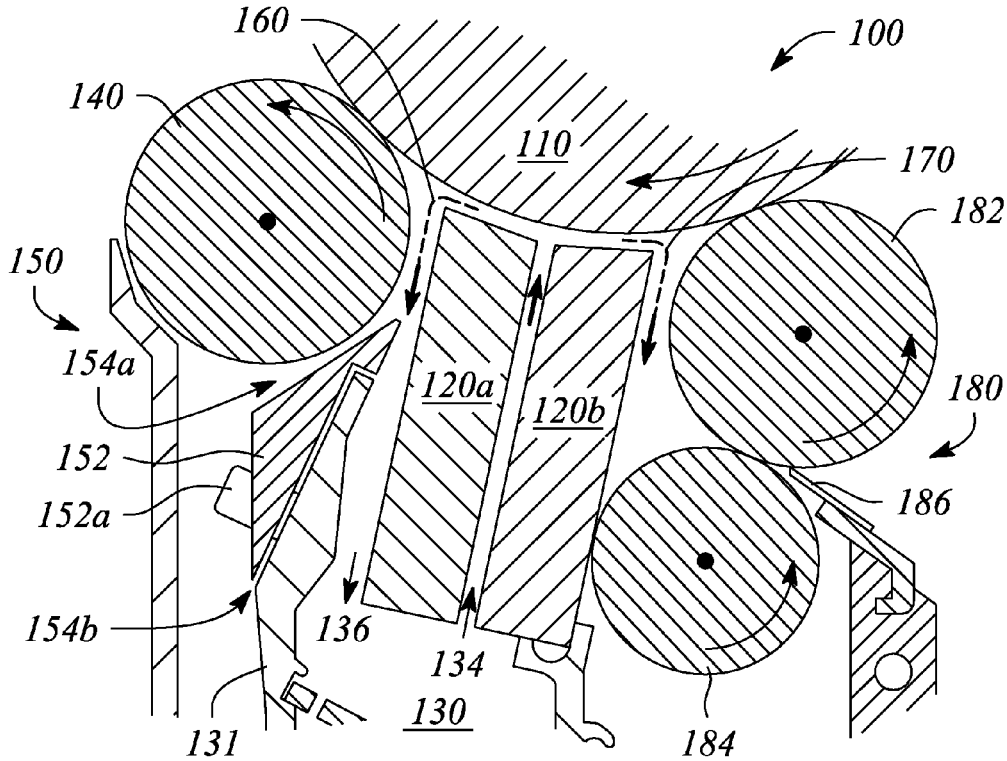
FIG. 1B illustrates a magnified view of an upper portion of the development apparatus of FIG. 1A, according to an example of the principles described herein.

FIG. 1A illustrates a cross sectional view of a development apparatus 100, according to an example of the principles described herein. FIG. 1B illustrates a magnified view of an upper portion of the development apparatus of FIG. 1A, according to an example of the principles described herein. As illustrated, the development apparatus 100 has a housing comprising housing walls 101, 103. The housing walls 101, 102 generally surround and enclose portions of the development apparatus 100. Further, the development apparatus 100 has an overflow side 102 and a cleaning side 104, as is further described below. The development apparatus 100 may be employed or used in a printer, for example.

The development apparatus 100 comprises a first roller 110, which may also be referred to herein as a developer roller 110. The first roller 110 rotates about an axis in a first direction, for example a clockwise direction, as indicated by an arrow in FIG. 1A. The surface of the first roller 110 is configured to receive a fluid, for example a liquid toner or ink, having colorant and toner particles in a dielectric carrier fluid that respond to electrical charge. Moreover, the surface of the first roller 110 is configured to maintain a voltage. The first roller 110 generally extends above and out of a top of the housing of the development apparatus 100, as illustrated.

The development apparatus 100 further comprises a pair of electrodes 120. A first electrode 120*a* of the pair is adjacent to and spaced from a second electrode 120*b* of the pair of electrodes 120. A gap between the spaced apart first and second electrodes 120*a*, 120*b* is sufficient for fluid flow between the electrodes 120. In some examples, the electrodes 120 are long, narrow, substantially rectangular bars that each extends for a portion of a length of the first roller 110. For example, both of the first roller 110 and the electrodes 120 may extend into the page of FIGS. 1A and 1B. Relatively narrow ends (i.e., top ends) of the electrodes 120 are adjacent to and spaced from the surface of the first roller 110 by a gap sufficient for fluid flow between the first roller 110 and the ends of the electrodes 120. The electrodes 120 are configured to maintain a voltage that differs from the voltage maintained by the first roller 110. The voltage difference produces an electric field between the narrow ends of the electrodes 120 and a surface of the first roller 110.

Opposite or bottom ends of the electrodes 120 are adjacent to and facilitate establishing a first end of a chamber 130. Chamber walls 131, 133 enclose and define the chamber 130 away from the first end of the chamber 130. The chamber 130 also may be referred to as a fluid chamber 130, for example. In some examples, the bottom end of the second electrode 120*b* is connected to a terminus end of the chamber wall 133 of the chamber 130, as illustrated.

The chamber 130 is configured to house a fluid. According to various examples, the fluid comprises a liquid component and a largely solid or relatively solid component. For example, the fluid may be the liquid toner or an ink comprising pigment particles (i.e., the largely solid component) suspended in a dielectric carrier fluid (i.e., the liquid component). A variety of liquid toners or inks (i.e., fluids) may be employed by the development apparatus 100 including, but not limited to, ELECTROINK® from Hewlett-Packard Co., Palo Alto, Calif., USA. The fluid (i.e., liquid toner or ink) housed by the fluid chamber 130 provides a source of fluid to the surface of the first roller 110.

In particular, during operation the fluid from the chamber 130 flows between the spaced apart electrodes 120 from an inlet 134 through the gap between the electrodes 120 and around the narrow ends of the electrodes 120 adjacent to the first roller 110. Flow of the fluid into the inlet 134 and between the electrodes 120 may be provided by a pressure of the fluid in the chamber 130, for example. Fluid flow may be further facilitated by rotation of the first roller 110, in some examples. In particular, some of the fluid, or more precisely the solid component of the fluid (e.g., colorant or toner particles) along with a relatively smaller portion of the liquid component, adhere to and are carried by a surface of the rotating first roller 110, according to some examples. According to various examples, the adhesion is promoted by the electric field between the narrow ends of the electrodes 120 and the first roller 110 acting on a charge of the solid component of the fluid (e.g., charged particles of the solid component).

The chamber 130 is connected to an external reservoir (not illustrated) at an inlet pipe 132. Fluid (e.g., ink) in the chamber 130 is provided and replenished from the external reservoir by way of the inlet pipe 132. Further, in some examples, the fluid in the chamber 130 is maintained under pressure by providing the fluid from the external reservoir. For example, a pump may be used to pump the fluid under pressure into the chamber 130 from the external reservoir. The chamber 130 further receives fluid via an outlet 136 from a recirculation flow path, as further described herein. In particular, fluid in the recirculation flow path that is not consumed by adhering to the first roller 110 or otherwise diverted as described below may enter the chamber 130 through the recirculation flow path outlet 136, according to various examples.

The chamber 130, as defined by the chamber walls 131, 133 and the bottom ends of the electrodes 120, is further substantially surrounded by the housing walls 101, 103 of the development apparatus 100. The housing walls 101, 103 further define and enclose a collection tray 190 near a bottom end of the housing. The collection tray 190 serves to receive and collect excess material (e.g., ink, or toner and fluid) from a surface of the first roller 110 at the cleaning side 104 of the development apparatus 100, as is further described below. The excess material may comprise residual amounts of the solid component of the fluid that remain after the first roller 110 has rotated about one revolution, for example. In addition, the collection tray 190 receives and collects fluid from an overflow flow path via the overflow side 102 of the development apparatus 100, as is further described below. Fluid communication extending from the overflow flow path to the collection tray 190 along and within the overflow side 102 is illustrated as a heavy arrow 105 in FIG. 1A, for example. The received and collected fluid and excess solid component from the collection tray 190 may be provided to the external reservoir for filtering, mixing and reuse, for example.

The development apparatus 100 further comprises a second roller 140 adjacent to the first roller 110 and the first electrode 120*a* of the electrode pair. A surface of the second roller 140 is substantially in contact with the surface of the first roller 110, according to some examples. The surface of the second roller 140 is configured to maintain a voltage that differs in magnitude from the voltage maintained on the first roller 110, in some examples. Moreover, the second roller 140 is configured to rotate in a second direction that is opposite to the first direction of the first roller 110 rotation (e.g., as indicated by an arrow within the second roller 140). The second roller 140 acts to one or both of compact and reduce a thickness of a portion of the fluid that adheres to and is carried by the first roller 110. In particular, the second roller 140 may compact a solid component of the adhering fluid and reduce or substantially remove the liquid component of the adhering fluid, according to some examples.

In some examples, the second roller 140 may be referred to as a squeegee roller 140 due to its 'squeegee' action on the surface of the developer roller 110 (e.g., removing the liquid component). The second roller 140 is also spaced from the first electrode 120*a* by a gap. The gap is sufficient for fluid flow between the second roller 140 and the first electrode 120*a*. In some examples, the second roller 140 is located between the first roller 110 and a terminus end of the housing wall 101 of the development apparatus 100 (e.g., as illustrated).

The development apparatus 100 further comprises flow paths for fluid to recirculate in the development apparatus 100. A first flow path is referred to as the recirculation flow path 160. The recirculation flow path 160 of the development apparatus 100 comprises a fluid pathway generally extending from the chamber 130 at the inlet 134, through the gap between the electrode pair 120 and between the first roller 110 and the first electrode 120*a*. The recirculation flow path 160 continues between the first electrode 120*a* and each of the second roller 140 and the flow director 150, and back to the chamber 130 at the recirculation flow path outlet 136. A second flow path is referred to as the cleaning flow path 170. The cleaning flow path 170 extends from the chamber 130 at the inlet 134, through the gap between the electrode pair 120 and between the second electrode 120*b* and the first roller 110. The cleaning flow path 170 continues on past a further series of rollers, which are described further below, and into the collection tray 190.

The development apparatus 100 further comprises means 150 for regulating fluid flow. The means 150 for regulating fluid flow is also referred to herein as a flow director 150. The flow director 150 is located proximate to the second roller 140 and the first electrode 120*a*. The flow director 150 comprises a flow director cap 152 that is tangentially adjacent to the second roller 140. The flow director cap 152 may also be considered a 'squeegee cap' given its relative proximity to the squeegee roller 140. Moreover and as illustrated, the flow director cap 152 is substantially attached to a terminus end of the chamber wall 131 that separates the chamber 130 from a housing wall 101 on the overflow side 102 of the development apparatus 100. In some examples, the flow director cap 152 is adjustably attached to the chamber wall 131 by an adjustment screw 152*a*. In contrast, the chamber wall 133 separates the chamber 130 from the opposite housing wall 103 on the cleaning side 104 of the development apparatus 100, as mentioned above.

The flow director 150 further comprises an overflow flow path from the recirculation flow path 160 to the overflow side 102 of the development apparatus 100. The overflow flow path generally enables fluid to escape or be released from the recirculation flow path 160 and enter the overflow side 102 of the development apparatus 100 between the housing wall 101 and the chamber wall 131. The fluid that escapes via the overflow flow path ultimately ends up in the collection tray 190. In particular, the overflow flow path may regulate fluid flow in the recirculation flow path 160, for example.

In some examples, the overflow flow path comprises, or is provided by, a gap 154*a* between the surface of the second roller 140 and a surface of the flow director cap 152. For example, the gap 154*a* may have a width dimension within a range of about 0.75 millimeters (mm) to about 1.2 mm. In some examples, the width of the gap 154*a* may range from about 0.8 mm to about 1.15 mm, or about 0.8 mm to about 1 mm, or about 0.8 mm to about 0.95 mm, or about 0.85 mm to about 1.15 mm, or about 0.85 mm to about 1 mm, or about 0.85 mm to about 0.95 mm. According to some examples, the gap 154*a* enables some of the fluid to escape from the recirculation flow path 160.

In some examples, the width of the gap 154*a* is adjustable to adapt to one or both of a flow rate of a particular fluid in the recirculation flow path 160 and a targeted amount of fluid flow to enter the overflow flow path of the flow director 150. In some examples, the gap 154*a* is adjustable by adjusting the adjustment screw 152*a*. In some examples, the width of the gap 154*a* is dependent on one or more of the flow rate of the fluid from the chamber 130 at the inlet 134 (i.e., the inlet flow rate at the inlet of the recirculation flow path 160), flow pressure, and the recirculation flow rate of the fluid in the recirculation flow path 160.

Figure 2:
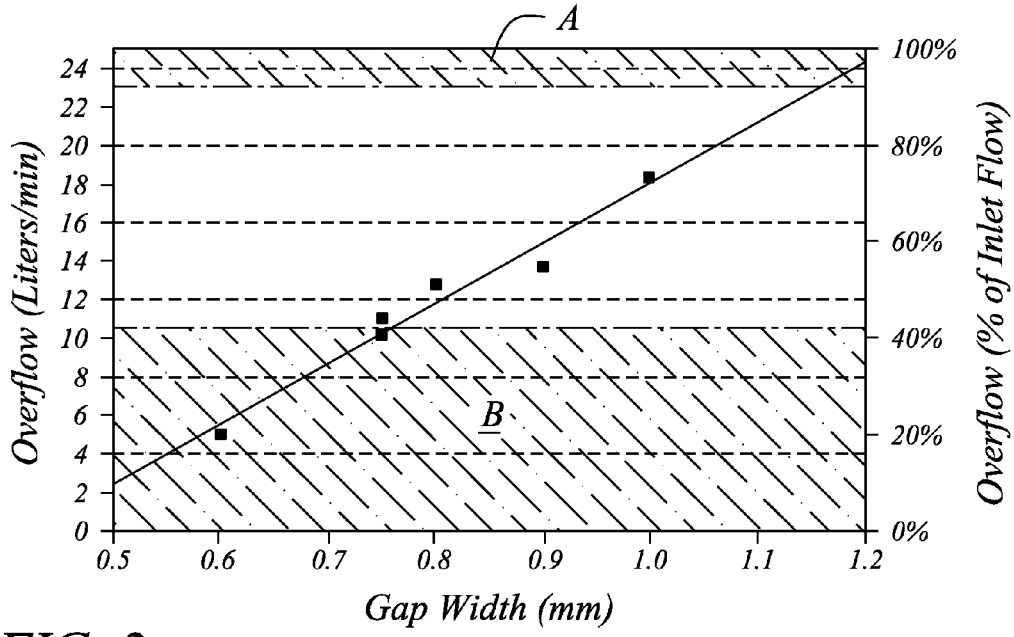
FIG. 2 illustrates a graph of gap width relative to overflow in an overflow flow path, according to an example of the principles described herein.

FIG. 2 illustrates a graph of gap width relative to overflow in an overflow flow path, according to an example of the principles described herein. In particular, FIG. 2 illustrates a graph of the gap width of the gap 154*a* between the second roller 140 and the flow director cap 152 relative to overflow in the overflow flow path provided by the gap 154*a* for an example of inlet flow rate (i.e., flow from the external reservoir through the inlet pipe 132 and into the chamber 130) and recirculation flow rate (i.e., along recirculation path 160). For the example, an inlet flow rate was about 25 liters per minute (L/min) and the recirculation flow rate was about 37 L/min. In FIG. 2, an upper region of the graph labeled 'A' refers to overflow amounts or values where sludge may begin to appear in the cleaning path 170 near the third and fourth rollers 182, 184, which are described further below, for example. Conversely, a region labeled 'B' in a lower portion of the graph in FIG. 2 represents overflow values where dark streaks may appear on a substrate (e.g., paper) that receives a printed image indirectly by way of the first roller 110, for example.

The graph in FIG. 2 illustrates that a gap 154*a* width within a range of about 0.75 mm and about 1.15 mm was sufficient to divert a range of about 11 L/min to about 23 L/min of the inlet fluid flow into the overflow flow path of the flow director 150. The range of diverted flow fluid equates to about 45% to about 90% of the inlet fluid flow from the chamber 130, as illustrated. Within the range of about 0.75 mm and about 1.15 mm, neither dark streaks nor sludge build-up was observed for the illustrated example. In other words, for the inlet flow rate and the recirculation flow rate of this example, a gap size of between about 0.75 mm and about 1.15 mm yielded acceptable results while a gap size outside this range may lead to either dark streak formation or sludge build-up, for this example.

In some examples, the range of diverted flow fluid ranges from about 50% to about 90% of the inlet fluid flow, or about 55% to about 85%, or about 50% to about 80%, or about 50% to about 75%, or about 55% to about 90%, or about 60% to about 90%, or about 60% to about 80%, or about 65% to about 90%, or about 70% to about 90%, or about 75% to about 90%, or about 80% to about 90%, or about 75% to about 85%.

Referring back to FIGS. 1A and 1B, in some examples the overflow flow path comprises, or is provided by, a channel 154*b* between a surface of the flow director cap 152 and the terminus of the chamber wall 131. For example, the channel 154*b* extends between the recirculation flow path 160 and the overflow side 102 of the development apparatus 100. In some examples, the channel 154*b* may be one continuous channel 154*b* that provides the overflow flow path. In other examples, the channel 154*b* may comprise a plurality of channels 154*b* spaced apart along the span of the flow director cap 152 (e.g., into the page of FIGS. 1A and 1B). In various examples, the channel 154*b* may be dimensioned to provide an overflow flow path that has overall or combined dimensions within a range of about 0.3 mm to about 1.5 mm. In yet other examples, the channel 154*b* may comprise another pathway (not illustrated) that connects between the recirculation flow path 160 and the overflow side 102 of the development apparatus 100. For example, the channel 154*b* may comprise one or more holes or vias in the chamber wall 131 along the recirculation flow path 160 before the outlet 136.

In some examples, the flow director 150 comprises both the gap 154*a* between a first surface of the flow director cap 152 and the surface of the second roller 140 and the channel 154*b* (e.g., between a second surface of the flow director cap 152 and the chamber wall terminus). In these examples, one or both of the gap 154*a* and the channel 154*b* will release a metered flow of fluid out of the recirculation flow path 160 through the overflow flow path of the flow director 150 to the overflow side 102 of the development apparatus and on into the collection tray 190. Moreover, one or both of the gap 154*a* and the channel 154*b* may release pressure within the recirculation flow path 160, for example. In some examples, the pressure release provided by the channel 154*b* may provide for a larger range of widths for the gap 154*a* to achieve the same results described above for the gap 154*a* width examples. For example, the second roller 140 may be rotated at a speed such that little to no fluid flows in the gap 154*a* over the large range of gaps 154*a* when the channel 154*b* is present. As such, the flow of fluid from the recirculation flow path 160 into the overflow flow path may be substantially regulated by the channel 154*b* rather than by adjusting the gap 154*a* width between the flow director cap 152 and the second roller 140, for example.

Figure 3:
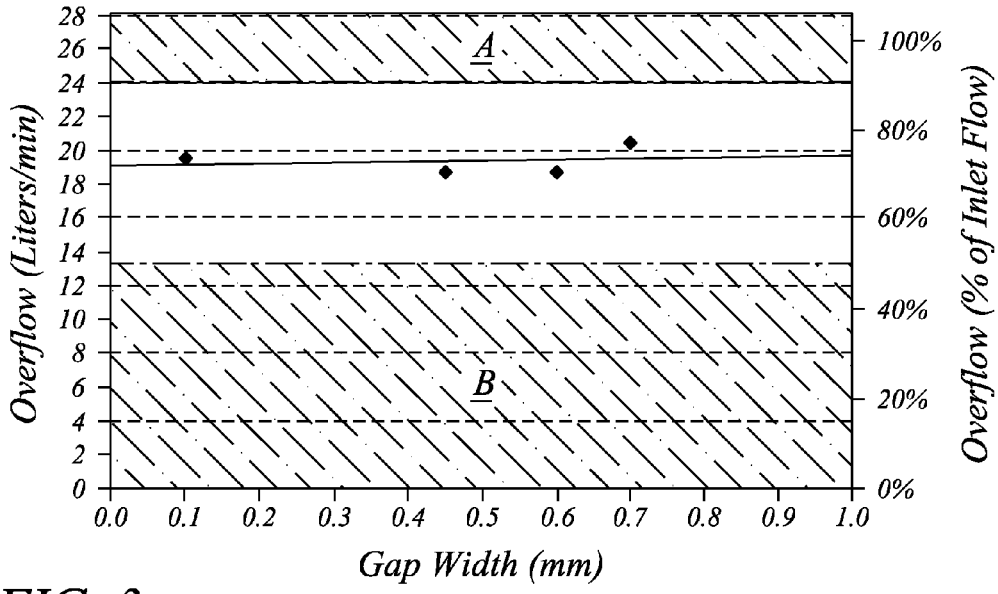
FIG. 3 illustrates a graph of gap width relative to overflow in an overflow flow path in the presence of a channel associated with a flow director, according to an example of the principles described herein.

FIG. 3 illustrates a graph of gap width relative to overflow in an overflow flow path in the presence of the channel 154*b* associated with the flow director 150, according to an example of the principles described herein. In particular, FIG. 3 illustrates a graph of the gap width of the gap 154*a* in the presence of the channel 154*b* with respect to overflow in the overflow path for an example of inlet flow rate and recirculation flow rate. Regions labeled 'A' and 'B' represent the overflow rates where sludge and dark streaks, respectively, may appear similar to the regions described above for FIG. 2. In this example, the inlet flow rate was about 26.5 L/min and the recirculation flow rate was about 38 L/min, which are relatively similar to the example described with respect to FIG. 2, by way of comparison.

As illustrated in FIG. 3, between about 14 L/min and about 24 L/min of the flow was diverted into the overflow flow path while still substantially avoiding both production of dark streaks on a printed substrate and build up of sludge. The diverted flow range equated to about 50% to about 90% of the inlet fluid flow, or for example about 75% of the fluid flow. Moreover as illustrated in FIG. 3, the gap 154*a* between the flow director cap 152 and the second roller 140 ranged in width from about 0.1 mm to 0.7 mm in this example, and still substantially avoided both streak production and sludge build-up when the channel 154*b* was also present. In some examples, the gap 154*a* may be substantially irrelevant when the channel 154*b* is present to avoid streak production and sludge build-up, as shown by extrapolation (from 0 mm to 1 mm) in FIG. 3.

However, even a relatively small gap 154*a* width will facilitate reduction of wear and tear on the second roller 140, for example. In particular, including the channel 154*b* may negate having a gap 154*a* width that is one or both precisely set and precisely maintained, for example.

Referring back to FIGS. 1A and 1B, in some examples, the development apparatus 100 further comprises a cleaning system 180 in the cleaning flow path 170 to the collection tray 190. The cleaning system 180 comprises a third roller 182 having a surface adjacent to the first roller 110 and adjacent to and spaced from the second electrode 120*b* of the electrode pair 120. The third roller 182 is configured to rotate in a direction that is opposite to the first direction of rotation of the first roller 110. An arrow illustrated within the third roller 182 indicates a rotation direction thereof, by way of example. In some examples, the surface of the third roller 182 is configured to maintain a voltage. A combination of the voltage of the third roller 182 surface and the rotation of the third roller 182 relative to the first roller 110 rotation acts to remove excess material from the first roller 110. The excess material may comprise remaining solid component of the fluid adhered to the first roller 110 that was not subsequently removed or otherwise utilized prior to reaching the third roller 182.

The cleaning system 180 further comprises a fourth roller 184 and a scraper blade 186. The scraper blade 186 is positioned adjacent to and in substantial contact with the third roller 182. The scraper blade 186 serves to remove from the third roller 182 the excess material collected by the third roller 182 from the first roller 110. The fourth roller 184 has a surface adjacent to the surface of the third roller 182, the scraper blade 186, and the second electrode 120*b*. In some examples, the surface of the fourth roller 184 comprises a sponge or sponge-like material. In some examples, the fourth roller 184 surface may be in contact with one or both of the third roller 182 and the second electrode 120*b* (e.g., as illustrated). The fourth roller 184 removes the excess material from the scraper blade 186, remixes it with fluid from the cleaning flow path 170 and allows the resultant mixture to drop into the collection tray 190. In some examples, the scraper blade 186 is held in position by a mounting structure that is located substantially between the fourth roller 184 and the housing wall 103 of the development apparatus 100.

As described above, the cleaning flow path 170 comprises a fluid path extending from between the second electrode 120*b* and the first roller 110. The cleaning flow path 170 continues past the third roller 182, the fourth roller 184, and into the collection tray 190 at the cleaning side 104. The cleaning flow path 170 provides fluid to assist in removing and washing away the excess material collected by the third roller 182 and removed therefrom by action of the scraper blade 186 and the fourth roller 184. In addition, the fluid also insures that sludge does not build up on the cleaning side 104 of the development apparatus 100 and in the collection tray 190. In some examples, the development apparatus 100 comprises a drain outlet (not illustrated) attached to the collection tray 190 for transferring excess material and fluid collected in the collection tray 190 to the external reservoir. In the external reservoir, the fluid and excess material may be filtered, remixed and added back into the fluid supply to the chamber 130 for reuse, for example.

In some examples, the development apparatus 100 is used in a printer or a printing press and provides a source of ink to the printer for use in establishing printed images on a substrate, for example color images. In some examples, printers that may use the development apparatus 100 include, but are not limited to, LEP-type printers, for example, an offset LEP printing press. The ink used in conjunction with the development apparatus 100 for the LEP-type printers is a particular kind of ink that comprises colorant and toner particles dispersed in a carrier fluid. The particles (i.e., as the solid component of the ink) become charged in the development apparatus 100 and are introduced by the developer roller 110 to a charged photoconductor surface that includes a latent image defined by charge. The charged toner particles of the ink adhere to the photoconductor in the defined latent image and a toner image is subsequently transferred to an intermediate blanket where the toner particles are fused, and then transferred to a substrate in a final image of fused toner particles, for example. Particles that are not adhered to the photoconductor and transferred become the excess material that enters the cleaning side 104 of the development apparatus 100, described above.

Figure 4:
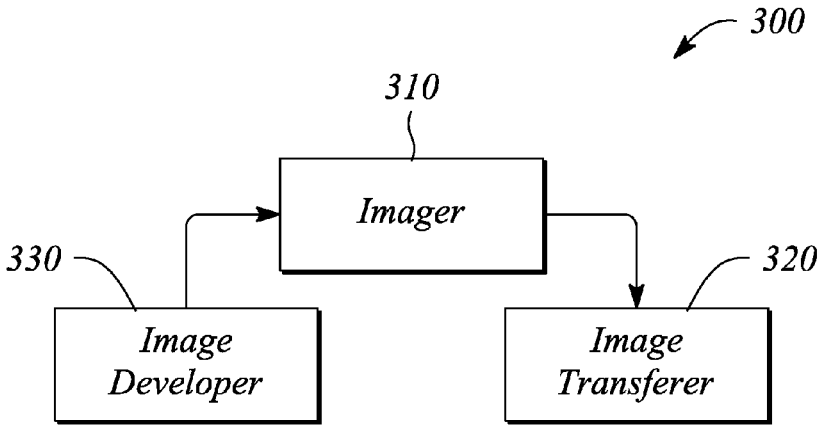
FIG. 4 illustrates a block diagram of a printer, according to another example of the principles described herein.

FIG. 4 illustrates a block diagram of a printer 300 according to an example of the principles described herein. The printer 300 comprises means 310 for forming a latent image (i.e., 'imager 310'). In some examples, the imager 310 comprises a writing head, a charging device and an imaging drum or roller. The writing head and the charging device work in concert to establish and fix the latent image on the imaging drum. In some examples, the imaging drum has a photoconductor imaging surface, and in some examples, the charging device is a corona discharge generator, a scorotron or a charge roller, and the writing head is an optical imager, such as a laser, for example.

The printer 300 further comprises means 320 for transferring a material image comprising an imaging material to a substrate. As illustrated in FIG. 4, the means 320 for transferring is referred to as an 'image transferer 320'. The image transferer 320 comprises an intermediate transfer medium (ITM) that is adjacent to the imager 310. The ITM may be a roller that includes a surface layer configured to receive the imaging material in the material image, for example, from the imaging drum. The image transferer 320 further comprises a pressure roller. The ITM and the pressure roller work in concert to transfer a fused material image to a substrate.

The printer 300 further comprises means 330 for developing the latent image into the material image (image developer 330'). The means 330 for developing is adjacent to and in contact with the means 310 for imaging a latent image. The means 330 for developing provide an imaging material to the imaging drum to form the material image. Imaging materials used for the printer 300 include, but are not limited to, liquid toner (i.e., LEP ink), for example HP ELECTROINK®, which comprise colorant and toner particles (that are capable of being charged) dispersed in a carrier fluid or other solvent. In some examples, the means 330 for developing comprises a developer apparatus that holds the imaging material. In some examples, the means 330 for developing comprises a plurality of the developer apparati. Each developer apparatus is configured to hold a different color imaging material to realize the material image. In some examples, the developer apparatus is substantially similar to the development apparatus 100 described above.

In particular, a developer apparatus of the plurality of developer apparati comprises a developer roller that has a surface adjacent to the means 310 for imaging, in particular, adjacent to the imaging drum. The developer apparatus further comprises a squeegee roller and an adjacent flow director. The squeegee roller has a surface in contact with the developer roller surface. The developer apparatus further comprises a recirculation flow path, and an overflow flow path that is supported by the flow director. The recirculation flow path extends from a chamber between a pair of electrodes, between the developer roller and a first electrode of the electrode pair, between the first electrode and each of the squeegee roller and the flow director and back to the chamber. The chamber is configured to hold the imaging material.

The overflow flow path extends from the recirculation flow path to an overflow side of the development apparatus that is adjacent to the chamber. The overflow side is configured to lead to a collection tray. In turn, the collection tray is configured to collect imaging material from the overflow flow path as well imaging material from a cleaning side of the development apparatus and then direct the collected imaging material to an external reservoir. In some examples, the overflow flow path comprises a channel between a first surface of the flow director and a terminal end (i.e., terminus) of a wall of the chamber in proximity to the first electrode. In other examples, the overflow flow path comprises a gap between the surface of the squeegee roller and a second surface of the flow director that is opposite to the first surface. In some examples, the overflow flow path comprises both the channel and the gap. In some examples, the overflow flow path comprises the channel and further comprises the gap having a width within a range of about 0 millimeter to about 1 millimeter. In these examples, the overflow flow path is configured to divert about 75% of the imaging material into the overflow flow path from the recirculation flow path.

In some examples, the printer 200 uses liquid electrophotography to form and to transfer the material image to a substrate. In these examples, the printer 200 is an LEP printing press. Moreover, in these examples, the imaging material held by the chamber is a liquid toner.

Thus, there have been described examples of a development apparatus and a printer that includes the development apparatus that both employ means for regulating fluid flow in a recirculation flow path of the development apparatus. It should be understood that the above-described examples are merely illustrative of some of the many specific examples that represent the principles of what is claimed. Clearly, those skilled in the art can readily devise numerous other arrangements without departing from the scope defined by the following claims.

What is claimed is:

1. A development apparatus comprising:

a first roller having a surface;

a chamber;

a pair of electrodes between the first roller and the chamber;

a second roller having a surface adjacent to the surface of the first roller;

a flow director between the second roller and a first electrode of the pair, the flow director comprising an overflow flow path to divert some fluid from a recirculation flow path that extends to and from the chamber.

2. The development apparatus of claim 1, wherein the overflow flow path comprises a channel between a surface of the flow director and a terminus of a wall of the chamber, the overflow flow path extending between the recirculation flow path and an overflow side of the development apparatus that leads to a collection tray.

3. The development apparatus of claim 1, wherein the overflow flow path comprises a gap between the surface of the second roller and a surface of the flow director, the overflow flow path extending between the recirculation flow path and an overflow side of the development apparatus that leads to a collection tray.

4. The development apparatus of claim 3, wherein a width of the gap ranges from about 0.75 millimeters to about 1.15 millimeters.

5. The development apparatus of claim 1, wherein the overflow flow path is sufficient to divert about 55% to about 85% of fluid from the recirculation flow path into a collection tray in proximity to the chamber.

6. The development apparatus of claim 1, wherein the overflow flow path comprises both a channel between a first surface of the flow director and a terminus of a wall of the chamber and a gap between the surface of the second roller and a second surface of the flow director, the second surface being opposite to the first surface, wherein a width of the gap ranges from about 0 millimeter to about 1 millimeter.

7. The development apparatus of claim 1, wherein the overflow flow path comprises a gap between the surface of the second roller and a surface of the flow director, a width of the gap being sufficient to divert more than 50% and less than 90% of fluid into a collection tray in proximity to the chamber.

8. The development apparatus of claim 1, wherein the recirculation flow path extends from the chamber between the electrode pair, between the first roller and the first electrode, between the first electrode and each of the second roller and the flow director, and back to the chamber.

9. The development apparatus of claim 1, further comprising a cleaning flow path extending from the chamber between the electrode pair, between a second electrode of the electrode pair and each of the first roller, a third roller, and a fourth roller, and to a collection tray in proximity to the chamber, the third roller having a surface adjacent to the first roller, the fourth roller having a surface adjacent to the third roller surface and the second electrode.

10. A development apparatus comprising:

a developer roller having a surface;

a fluid chamber;

a pair of electrodes between the developer roller and the fluid chamber;

a squeegee roller and a flow director cap adjacent to and spaced from a first electrode of the pair, the squeegee roller having a surface adjacent to the surface of the developer roller; and an overflow flow path between a recirculation flow path and an overflow side of the development apparatus that leads to a collection tray in proximity to the fluid chamber, the overflow flow path being adjacent to the flow director cap.

11. The development apparatus of claim 10, wherein the overflow flow path comprises a channel between a surface of the flow director cap and a terminus of a wall of the fluid chamber.

12. The development apparatus of claim 10, wherein the overflow flow path comprises a gap between the surface of the squeegee roller and a surface of the flow director cap.

13. The development apparatus of claim 12, wherein the gap ranges from about 0.85 millimeters to about 0.95 millimeters.

14. The development apparatus of claim 10, wherein the overflow flow path is sufficient to divert about 60% to about 80% of fluid into the collection tray.

15. The development apparatus of claim 10, wherein the overflow flow path comprises both a channel between a first surface of the flow director cap and a terminus of a wall of the fluid chamber and a gap between the surface of the squeegee roller and a second surface of the flow director cap that is opposite to the first surface, a width of the gap ranging from about 0.1 millimeter to about 1.0 millimeter.

16. The development apparatus of claim 10, wherein the recirculation flow path extends from the fluid chamber between the electrode pair, between the developer roller surface and the first electrode, between the first electrode and the squeegee roller surface, between the first electrode and the flow director cap and back to the fluid chamber.

17. A printer comprising:

means for forming a latent image;

means for transferring a material image to a substrate; and a developer to develop the latent image into the material image, the developer comprising a plurality of developer apparati, wherein each developer apparatus comprises:

a developer roller having a surface adjacent to the imaging means;

a squeegee roller and an adjacent flow director, the squeegee roller having a surface in contact with the surface of the developer roller;

a recirculation flow path extending from a chamber between a pair of electrodes, between the developer roller and a first electrode of the pair, between the first electrode and each of the squeegee roller and the flow director and back to the chamber; and an overflow flow path supported by the flow director.

18. The printer of claim 17, wherein the overflow flow path comprises one or both of a channel between a first surface of the flow director and a terminus of a wall of the chamber and a gap between the surface of the squeegee roller and a second surface of the flow director opposite the first surface, the overflow flow path extending from the recirculation flow path to a collection tray adjacent to the chamber.

19. The printer of claim 18, wherein the overflow flow path comprises both the channel and the gap having a width within a range of about 0.1 millimeter to about 1 millimeter to divert about 75% of fluid in the recirculation flow path into the overflow flow path.

20. The printer of claim 17, further comprising a liquid toner in the chamber of the image developing means, wherein the printer uses liquid electrophotography to form and to transfer the material image to a substrate.

* * * * *